US011324992B2

(12) United States Patent
Wu et al.

(10) Patent No.: US 11,324,992 B2
(45) Date of Patent: May 10, 2022

(54) EXERCISE BAR

(71) Applicants: Liang Han Wu, Xiamen (CN); Blake Kassel, Boca Raton, FL (US)

(72) Inventors: Liang Han Wu, Xiamen (CN); Blake Kassel, Boca Raton, FL (US)

(73) Assignee: Blake Kassel, Boca Raton, FL (US)

( * ) Notice: Subject to any disclaimer, the term of this patent is extended or adjusted under 35 U.S.C. 154(b) by 57 days.

(21) Appl. No.: 16/951,564

(22) Filed: Nov. 18, 2020

(65) Prior Publication Data

US 2021/0154522 A1 May 27, 2021

Related U.S. Application Data

(63) Continuation-in-part of application No. 16/692,497, filed on Nov. 22, 2019, now abandoned.

(51) Int. Cl.

| | |
|---|---|
| ***A63B 21/00*** | (2006.01) |
| ***A63B 1/00*** | (2006.01) |
| ***A63B 23/035*** | (2006.01) |
| *A63B 21/062* | (2006.01) |

(52) U.S. Cl.

CPC ..... *A63B 21/4035* (2015.10); *A63B 1/00* (2013.01); *A63B 23/03525* (2013.01); *A63B 21/0628* (2015.10); *A63B 2210/50* (2013.01); *A63B 2225/09* (2013.01)

(58) Field of Classification Search

CPC . A63B 21/0628; A63B 21/10; A63B 21/4001; A63B 21/4033–4035; A63B 21/00043; A63B 21/15–151; A63B 23/12–1227; A63B 23/1245; A63B 23/1281

See application file for complete search history.

(56) References Cited

U.S. PATENT DOCUMENTS

| | | | |
|---|---|---|---|
| 4,682,774 | A | 7/1987 | Holy |
| 5,029,847 | A | 7/1991 | Ross |
| 5,312,314 | A | 5/1994 | Stephan et al. |
| 7,572,212 | B2 | 8/2009 | Cassidy et al. |
| 7,591,763 | B1 | 9/2009 | Fucci |
| 8,075,461 | B2 | 12/2011 | Terry et al. |
| 8,672,815 | B1 | 3/2014 | Springer |
| 9,011,304 | B2 | 4/2015 | Gilman |
| D748,745 | S | 2/2016 | Hansen |
| 9,254,410 | B1 | 2/2016 | Mirza |
| 9,302,142 | B2 | 4/2016 | Berry et al. |

(Continued)

FOREIGN PATENT DOCUMENTS

WO 2005051492 A2 6/2005

*Primary Examiner* — Andrew S Lo

(74) *Attorney, Agent, or Firm* — Caesar Rivise, PC

(57) ABSTRACT

A collapsible exercise bar includes two elongate sections; attachment means for connecting the two elongate sections together and for permitting the two elongate sections to move relative to each other between a position in which the two elongate sections are aligned for use of the bar, and a folded position in which the two elongate sections are generally parallel to each other. A retainer member is slidable relative to the two elongate sections and includes attachment means for engaging cooperating attachment means on one of the two elongate sections to immobilize the retainer member in a position overlying contiguous edges of the two elongate sections when the two elongate sections are aligned for use of the bar. A connector is provided on the exercise bar and is configured to be connected to a resistance device.

17 Claims, 14 Drawing Sheets

(56) References Cited

U.S. PATENT DOCUMENTS

| | | | |
|---|---|---|---|
| 9,782,620 | B2 | 10/2017 | Morales et al. |
| 2006/0105890 | A1 | 5/2006 | Logue |
| 2009/0192022 | A1 | 7/2009 | Kulka |
| 2010/0130334 | A1 | 5/2010 | Roney et al. |
| 2011/0319184 | A1 | 12/2011 | Young |
| 2013/0196830 | A1 | 8/2013 | Pfitzer |
| 2014/0221173 | A1 | 8/2014 | Crabtree et al. |
| 2014/0287886 | A1 | 9/2014 | Patti |
| 2016/0047405 | A1 | 2/2016 | Curley |
| 2017/0021219 | A1 | 1/2017 | Kelly |
| 2018/0001130 | A1 | 1/2018 | Sanders |
| 2018/0326245 | A1 | 11/2018 | Davis |
| 2020/0054917 | A1 | 2/2020 | Lin et al. |

EXERCISE BAR

RELATED APPLICATION

This application is a continuation in part application of pending application Ser. No. 16/692,497, filed on Nov. 22, 2019.

BACKGROUND OF THE INVENTION

Field of Invention

This invention relates to a collapsible exercise bar, and more particularly to a collapsible exercise bars designed for use with a stack of weights or other resistance device.

Description of Related Art

It is very desirable to provide collapsible exercise equipment that can be collapsed or folded into a compact condition for storage or transport. Collapsible exercise bars have been disclosed in the prior art. Representative collapsible, or modular exercise bars are disclosed in U.S. Pat. No. 4,682,774 (Holy) and U.S. Pat. No. 5,029,847 (Ross), and in International Publication No. WO 2005/051492 (Sewitch et al.). A collapsible golf alignment aid including multiple rods is disclosed in U.S. Patent Publication 2011/0319184 (Young).

Applicant is not aware of any collapsible exercise bars that can effectively be locked and maintained in an operating condition, and which can be connected to a stack of weights or other resistance device to provide a variety of exercises in which movement of the exercise bar is opposed by weights in the stack or by another resistance device, e.g., bicep curls, lat pulldown, triceps exercise, etc.

All references cited herein are incorporated herein by reference in their entireties.

BRIEF SUMMARY OF THE INVENTION

A collapsible exercise bar includes two elongate sections; attachment means in the form of a joining connector for connecting or joining the two elongate sections together and for permitting the two sections to move relative to each other between a position in which the two sections are aligned for use of the bar, and a folded position in which the two elongate sections are generally parallel to each other. A locking device is secured to one of the two elongate sections and has a locking member for engaging a locking region associated with said other of the two elongate sections for maintaining the two elongate sections aligned for use of the bar. A retainer member is slidable relative to the two elongate sections and includes attachment means for engaging cooperating attachment means on one of the two elongate sections to immobilize the retainer member in a position overlying contiguous edges of the two elongate sections when the two elongate sections are aligned for use of the bar. At least one additional connector is provided on the exercise bar and is configured to be connected to a stack of weights or other resistance device.

In a preferred embodiment of the invention, the connector that is configured to be connected to a stack of weights or other resistance device is on the retainer member; preferably connected to the retainer member by a tether.

In an alternative embodiment the connector that is on the retainer member for connecting to a stack of weights or other resistance device is integrally formed as part of the retainer member.

In a preferred embodiment of the invention, connectors configured to be connected to a stack of weights or other resistance device are provided on the retainer member and also at opposed ends of the exercise bar.

In preferred embodiments of the invention, the two elongate sections of the exercise bar include undulating segments to be gripped by an individual when the two elongate sections are aligned for use of the bar, said two elongate sections including cooperating members configured to engage with each other only when said two elongate sections are in a desire rotational orientation and to maintain said two elongate sections in said desired rotational orientation.

In accordance with the preferred embodiments of this invention employing two elongate sections with undulating segments, those elongate sections are maintained in a desired rotational orientation in which the undulating segments of both sections are in the same plane.

In a preferred embodiment of this invention the cooperating members that maintain the two elongate sections of the exercise bar in a desired rotational orientation with respect to each other include a connector on one of the elongate sections, said connector including an inwardly directed projection biased inwardly, an axially extending groove associated with the other of said two elongate sections, said inwardly directed projection cooperating with surfaces defining said axially extending groove only when said two elongate sections are linearly and rotationally aligned for use of the exercise bar.

In the most preferred embodiment of the invention the two elongate sections of the collapsible exercise bar include cooperating end segments, one of said cooperating end segments being an outer telescoping segment and the other of said cooperating end segments being an inner telescoping segment, said inner telescoping segment being seatable within said outer telescoping segment when said two elongate sections are aligned for use of said exercise bar, said locking device being secured to said outer telescoping segment, said locking member of said locking device including an inwardly directed projection normally flexibly biased inwardly; said inner telescoping segment including said locking region, said locking region being an elongate recess in an outer wall of said inner telescoping segment, said inwardly directed projection engaging within said elongate recess when said inner telescoping segment is fully seated within said outer telescoping segment for use of the exercise bar.

In the most preferred embodiment, the retainer member includes an inner surface for engaging the locking member of the locking device and providing an inward force for aiding in maintaining the projection in the elongate recess constituting the locking region of the inner telescoping member.

BRIEF DESCRIPTION OF SEVERAL VIEWS OF THE DRAWINGS

The invention will be described in conjunction with the following drawings in which like reference numerals designate like elements and wherein.

DESCRIPTION OF PREFERRED EMBODIMENTS OF THE INVENTION

Figure 1:
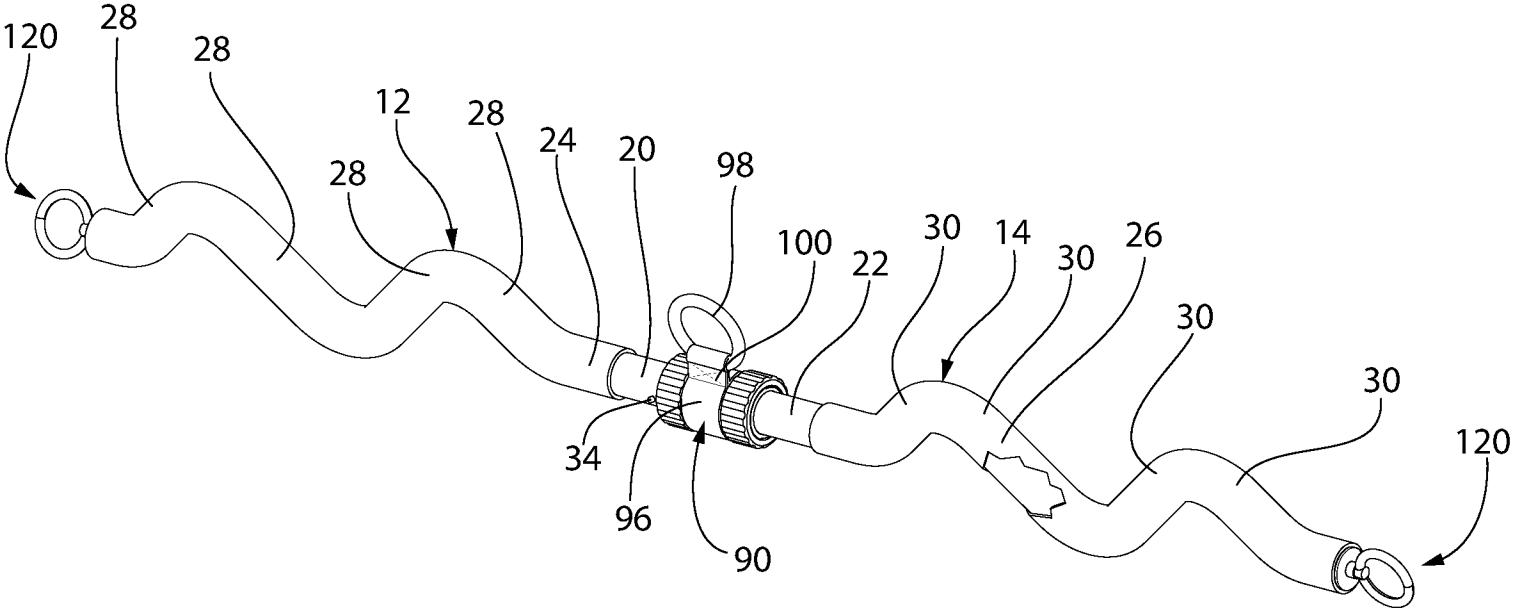
FIG. 1 is an isometric view of a collapsible exercise bar in an operative condition for attachment to a stack of weights or other resistance device.

Referring to FIGS. 1-3, 5 and 9A-9D, a collapsible exercise bar in accordance with this invention is shown at 10. The exercise bar 10 includes two elongate sections 12 and 14; each having a hollow interior section 16, 18, respectively. The hollow interior sections 16 and 18 are provided by peripheral walls 20, 22, respectively, and the elongate sections 12 and 14 are made of a strong material, preferably steel or other metal, as is well known by those skilled in the art. Referring to FIGS. 1-3 and 9A-9D, each of the elongate sections 12 and 14 includes an outer covering 24, 26, respectively. These coverings are provided to make it easier or more comfortable for a person to grip or engage the exercise bar 10 during use of said bar. Any suitable material can be used for the coverings, including rubber or a conformable plastic material. The specific composition of the outer coverings 24 and 26 does not constitute a limitation on the broadest aspects of this invention.

Figure 2:
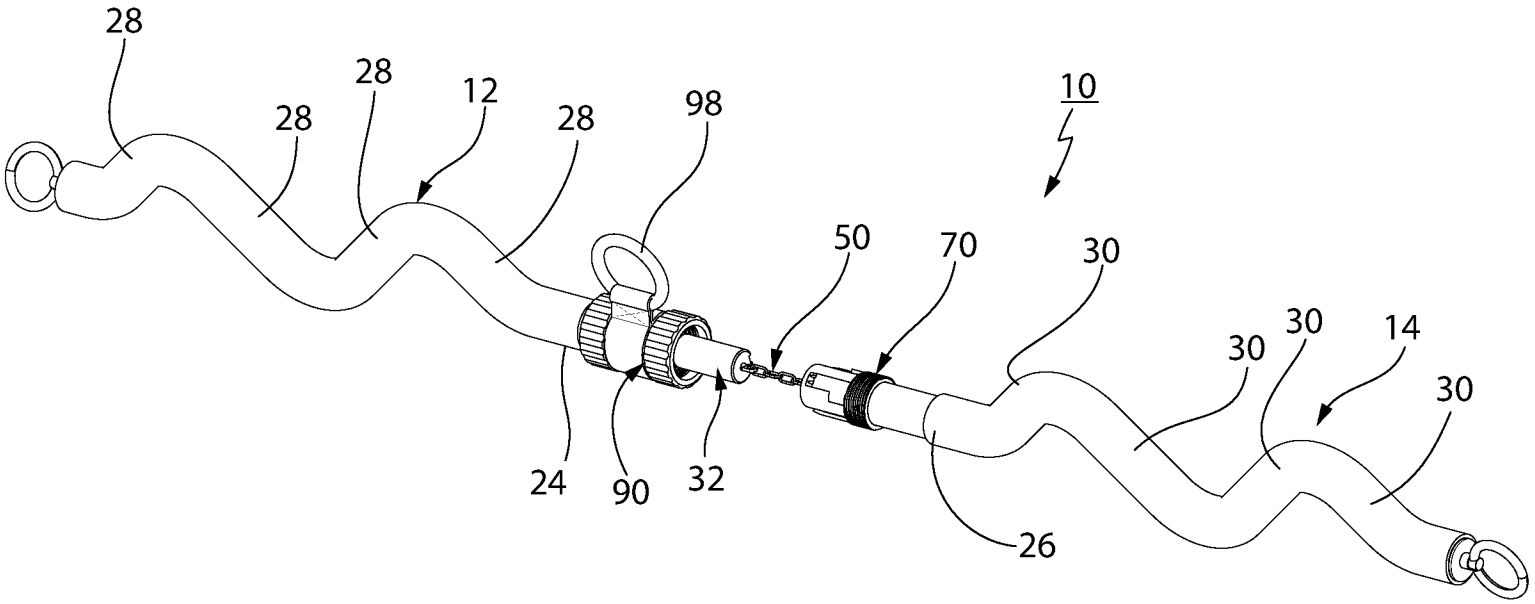
FIG. 2 is an exploded isometric view of the collapsible exercise bar of FIG. 1, with collapsible sections of the exercise bar shown separated from each other.
Figure 5:
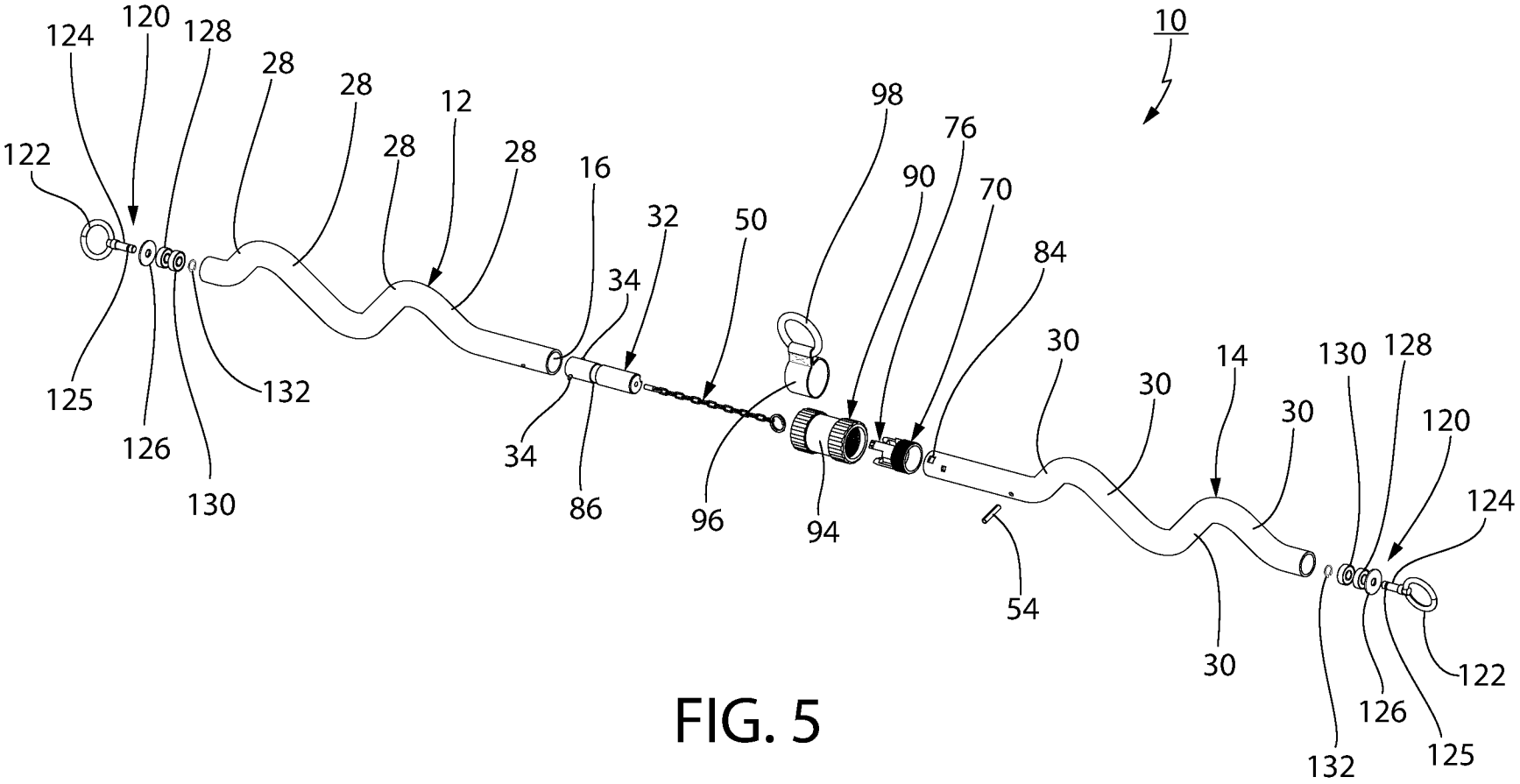
FIG. 5 is an exploded isometric view of the various parts of the collapsible exercise bar of this invention, omitting the outer covering of the elongate sections thereof.

Referring to FIGS. 1, 2 and 5, the elongate section 12 includes undulating segments 28 and the elongate section 14 includes undulating segments 30. Preferably adjacent undulating segments on each of the sections 12 and 14 are disposed at a 90-degree angle to each other. However, the specific angular relationship is not a limitation on the broadest aspects of this invention. It should be understood that providing undulating segments in an exercise bar is a common expedient and provides segments that are easily gripped by an individual conducting an exercise with the bar, e.g., a bicep curl.

Figure 9A:
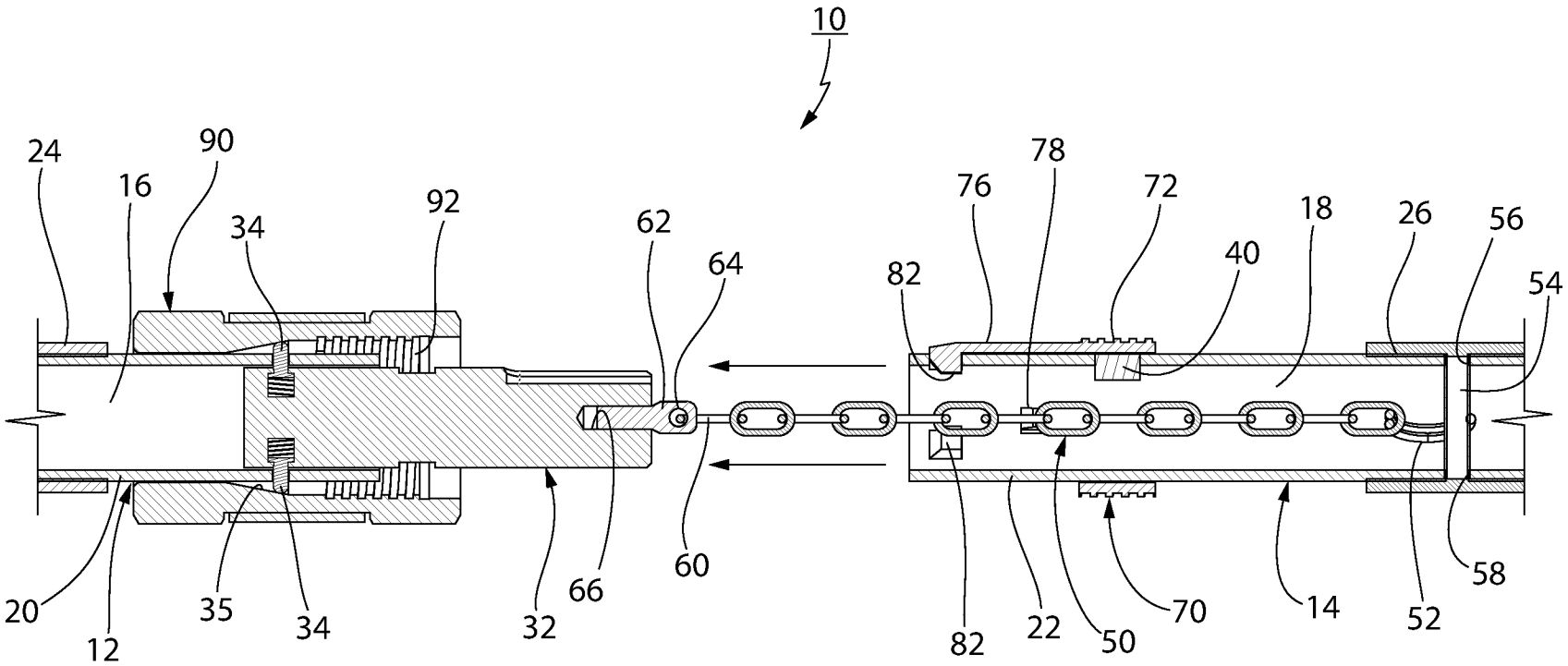
FIGS. 9A-9D show sequential steps of connecting and retaining sections of the collapsible exercise bar in operable condition for use in connection with a weight stack or other resistance device.
Figure 9B:
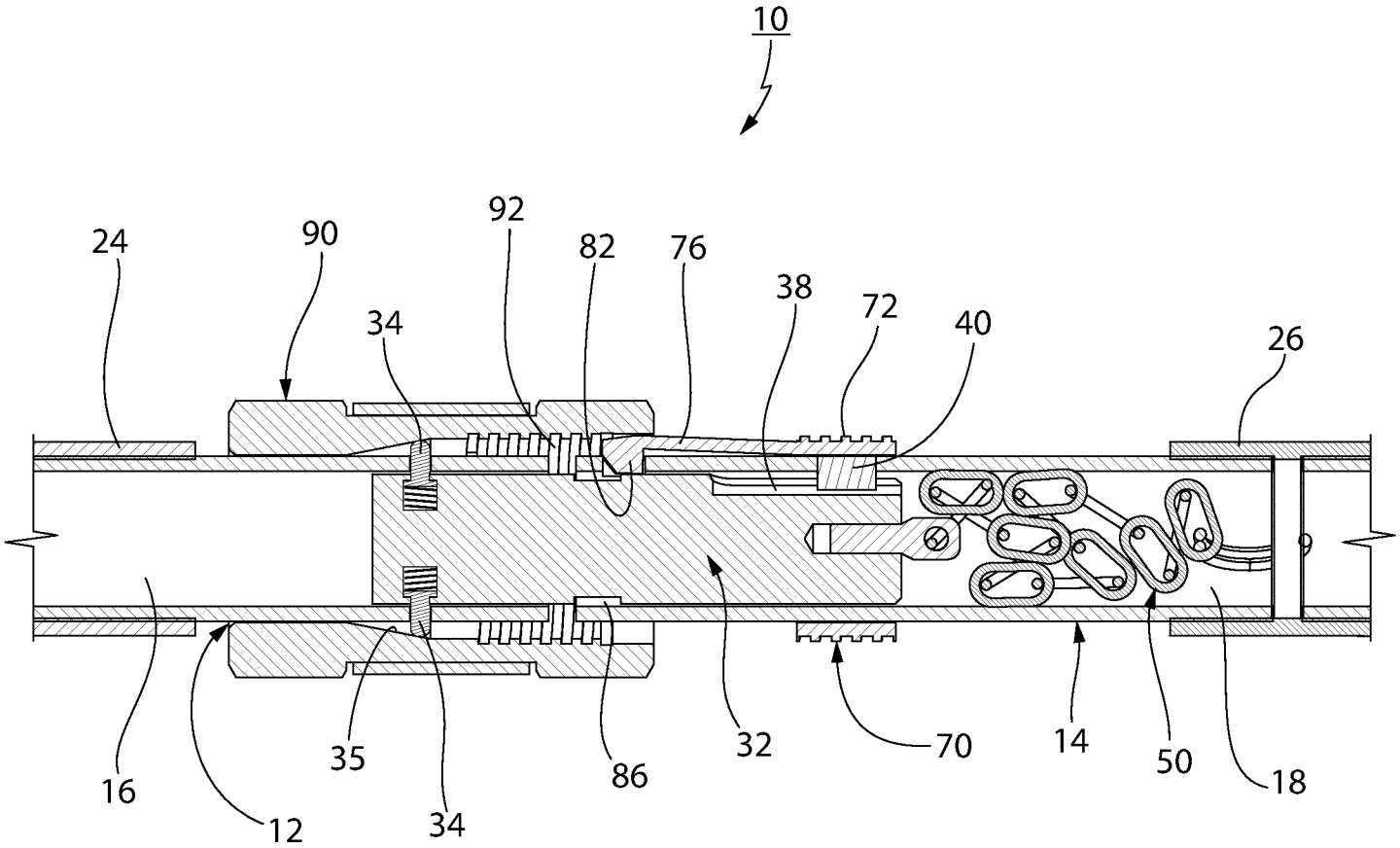
Figure 9C:
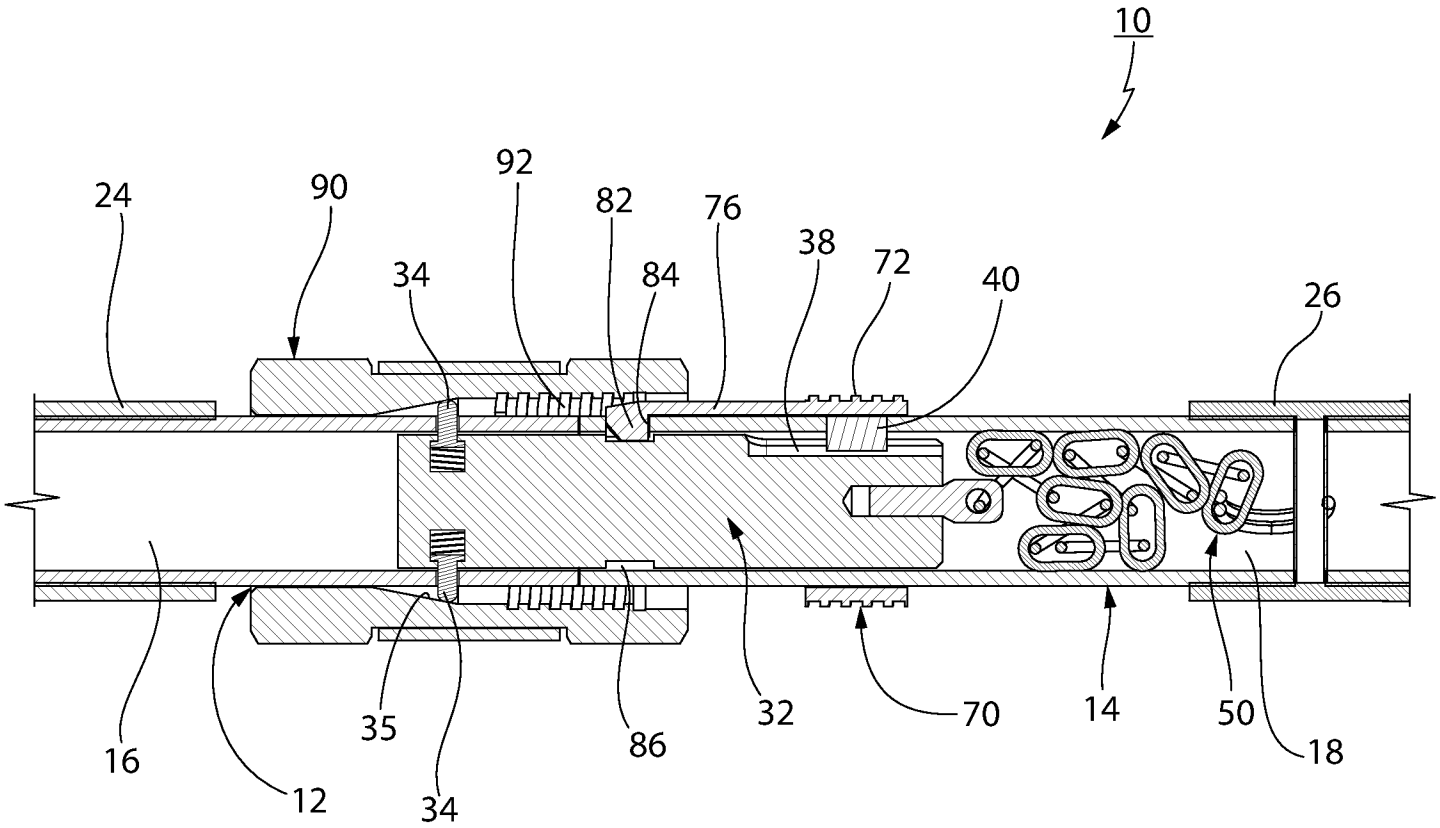
Figure 9D:
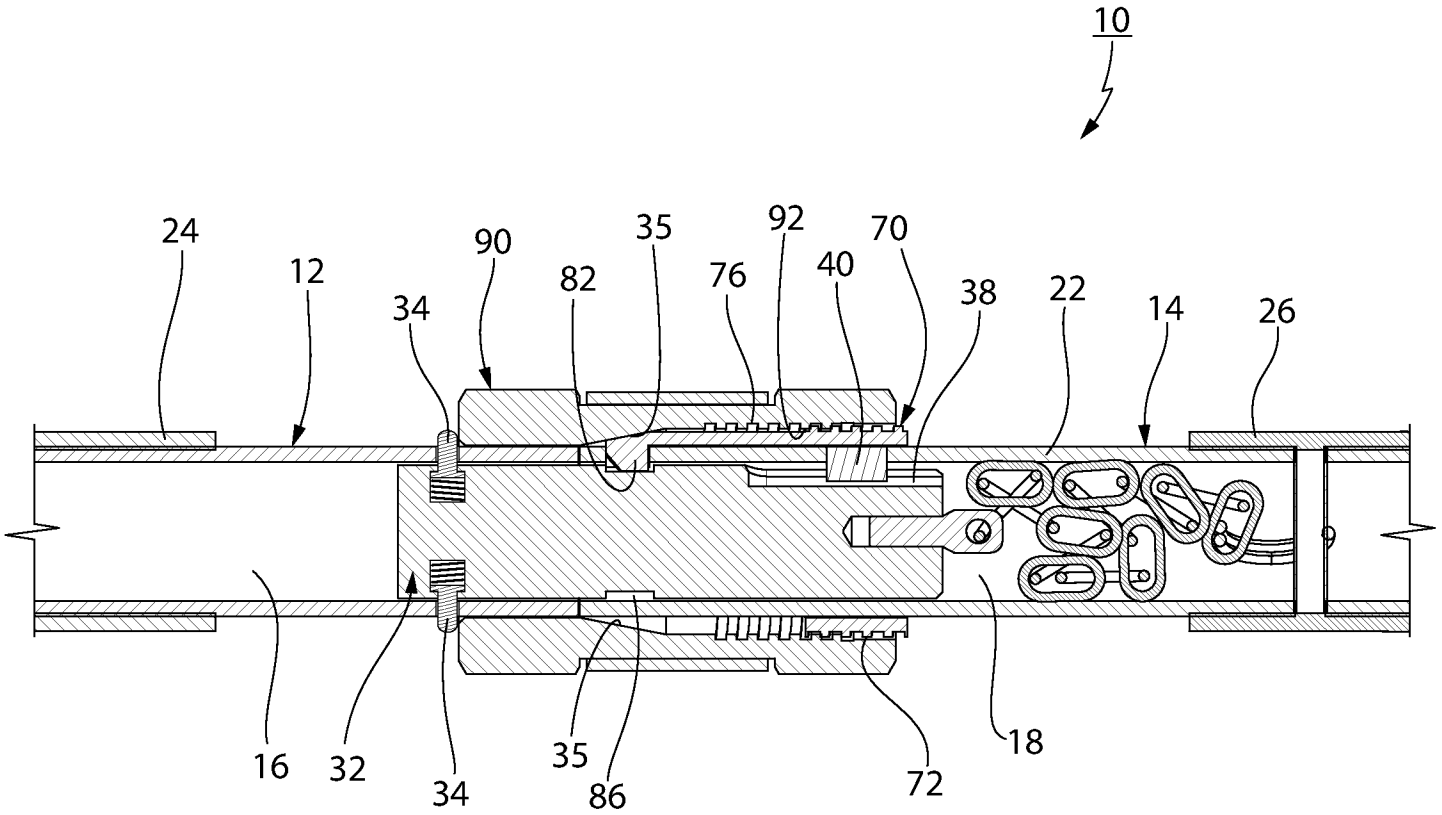

Referring to FIGS. 2, 3, 5 and 9A-9D, elongate section 12 further includes an elongate connector 32 retained in a fixed position within hollow interior 16 by being welded therein (not shown). A pair of diametrically opposed spring loaded projections 34 are biased outwardly through the outer wall 20 of section 12 to frictionally engage the inner, inclined surface 35 of retaining sleeve 90 and thereby prevent the retaining sleeve 90 from sliding or moving off of the section 12 until it is manually moved to provide its retaining function. (See FIGS. 7B and 9A-D). When it is desired to axially slide the retaining sleeve 90 into an operative position connected to connecting clip 70, as is shown in FIG. 9D and as will be described in greater detail hereinafter, the projections 34 can be biased inwardly by the inner surface of the retaining sleeve 90 as the sleeve is manually moved axially to permits the retaining sleeve 90 to be slid into a position for engagement with connecting clip 70. Although it is most preferred to employ diametrically opposed, spring loaded projections 34 to provide balance, in accordance with the broadest aspects of this invention a single spring-loaded projection 34 can be employed. Most preferably, as shown in FIG. 9D, the spring loaded projections 34 are positioned to be outside of the confines of sleeve 90 when the sleeve is fully engaged with connecting clip 70, to thereby return to their extended positions to aid in preventing the sleeve 90 from inadvertently coming unscrewed from the connecting clip 70 when the exercise bar is in its operative position. In addition, when the projections 34 spring outwardly they provide a visible indication that the retaining sleeve 90 and connecting clip 70 are tightly connected together. The elongate connector 32 is coupled to and is considered a part of elongate section 12, unless otherwise specified herein.

Referring to FIGS. 9A-9D, the elongate connector 32 of elongate section 12 includes an axially extending recess 38 in an outer surface thereof for receiving a projection 40 extending inwardly into a hollow region 18 of the elongate section 14, when sections 12 and 14 are in a desired, rotational orientation with respect to each other, as described in greater detail hereinafter. The projection 40 extends through passage 41 (FIG. 8) in the outer wall 22 of elongate section 14. Preferably the axially extending recess 38 is wedge-shaped at its entrance (not shown) to aid in guiding the projection 40 into said recess.

By way of brief explanation, when the sections 12 and 14 including undulating segments 28 and 30, respectively, are connected for use, it is desired that those undulating segments lie in a common plane. The cooperation of the axially extending recess 38 and inwardly directed projection 40 ensures that the rotational orientation of sections 12 and 14, when connected together, provides and maintains the undulating segments 28 and 30 in a common plane. It should be noted that when the elongate sections 12 and 14 are connected together the elongate connector 32 of elongate section 12 telescopes within hollow interior 18 of elongate section 14. (See FIGS. 9C and 9D).

Referring to FIGS. 2-5 and 9A-9D, it can be seen that the elongate sections 12 and 14 are connected or joined together by a flexible joining connector 50, preferably in the form of a chain. One end of the chain 50 has a connector ring 52 retained about an expansion retaining pin 54. The connector ring 52 is positioned in the interior of elongate section 14 in axial alignment with diametrically opposed openings 56, 58 that are formed (e.g., by drilling) through peripheral wall 22 of the elongate section 14. The expansion retaining pin 54 is then hammered through the diametrically opposed openings 56, 58 of the peripheral wall and through the connector ring 52 aligned therewith. Once the expansion pin 54 is inside the tube it expands against the tube wall and is firmly secured therein to retain the connector ring 52 of the chain 50 in its desired location within the elongate section 14 (e.g., see FIGS. 4 and 9A). It should be noted that the specific manner in which the chain is maintained connected to the elongate section 14 is not a limitation on the broadest aspects of this invention.

The end of chain 50 opposed to the connector ring 52 includes a link 60 thereof connected to a pin 62 through an opening 64 therein (see FIG. 9A). The pin 62 can be connected into passage 66 extending inwardly from distal end of the connector 32 by any suitable means, e.g., threading, welding, or the like. Most preferably the pin 62 is threaded into passage 66 for retention therein.

Figure 3:
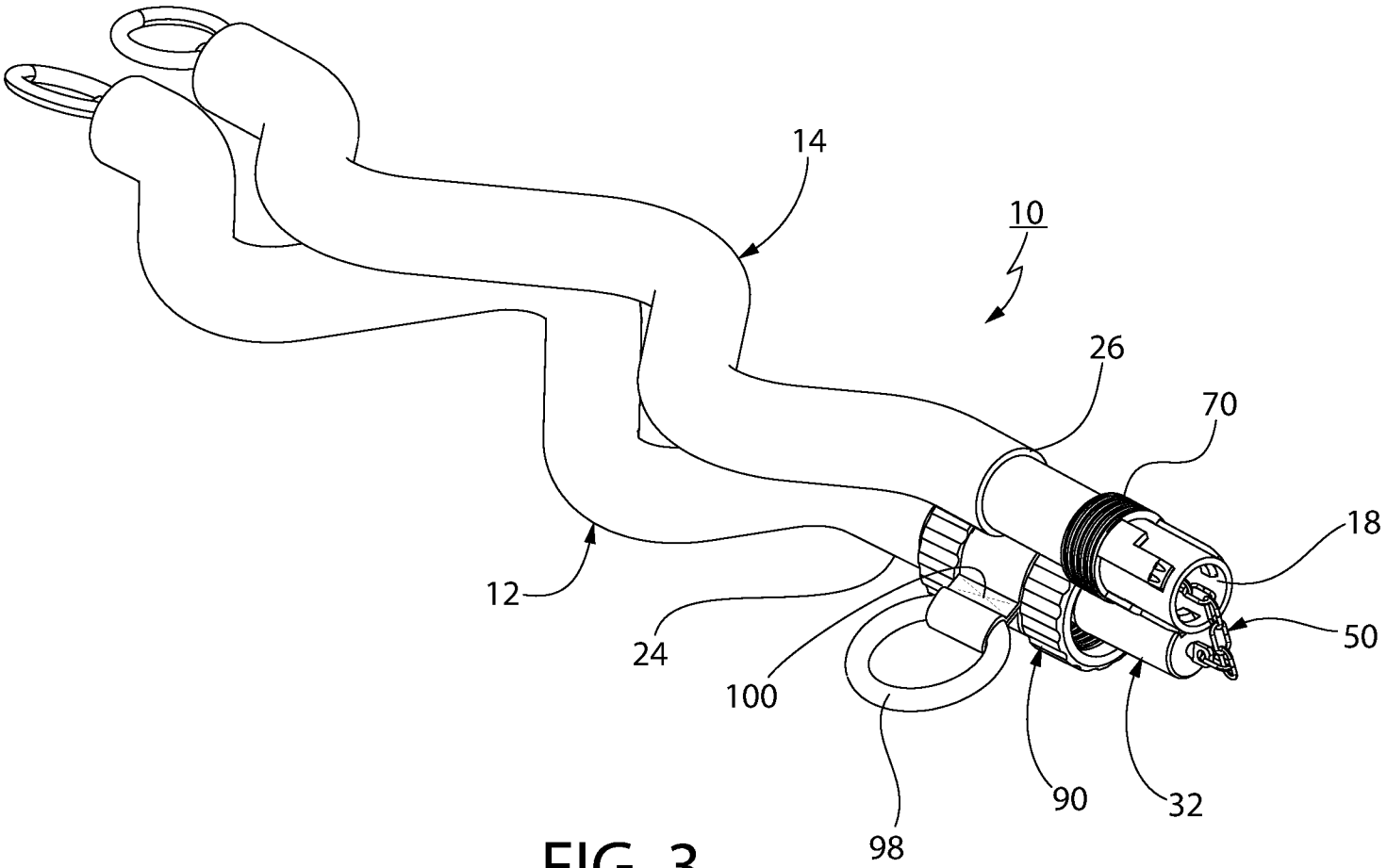
FIG. 3 is an isometric view of the exercise bar of FIG. 1, shown in a collapsed condition for storage or transport.
Figure 4:
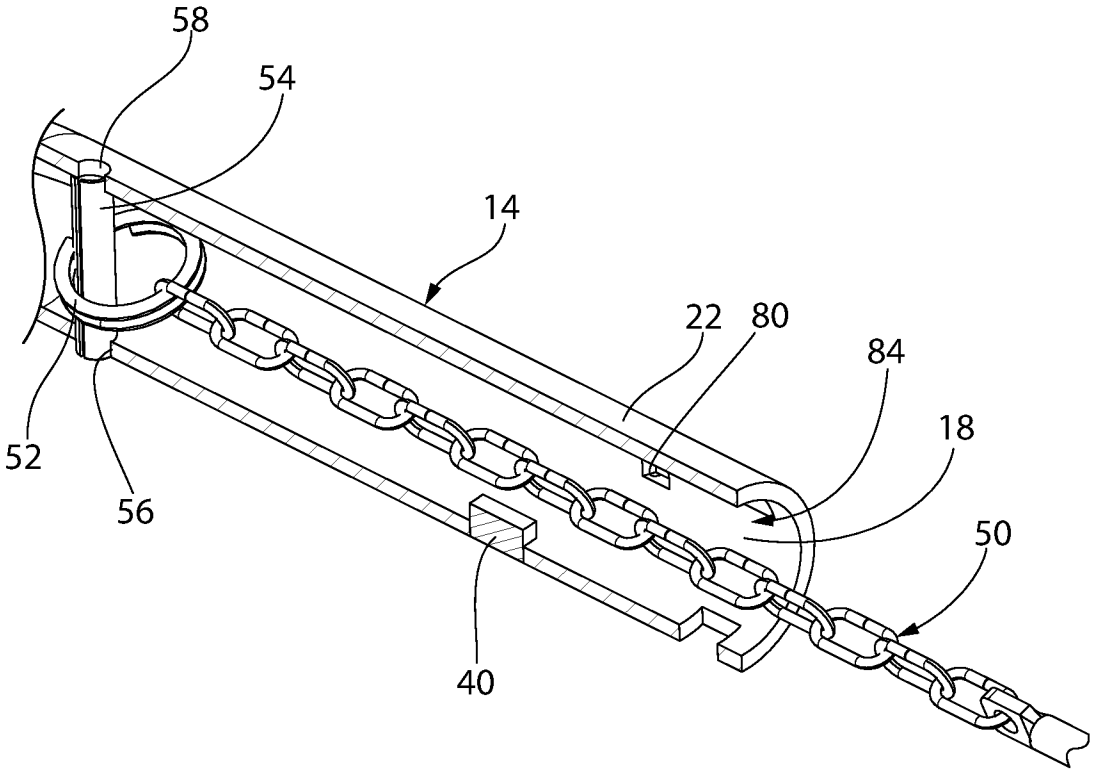
FIG. 4 is a fragmentary isometric view of a section of the collapsible exercise bar of this invention, broken away to show details of construction.

Referring to FIG. 3, the exercise bar 10 is shown in a collapsed condition with elongate sections 12 and 14 disengaged from each other and folded into overlying relationship for storage and transport. The flexible connector 50, in the form of a chain, maintains the sections 12 and 14 connected together and prevents the slidable retaining member or sleeve 90, to be described in detail hereinafter, from separating from the collapsed assembly. Moreover, the spring-loaded projections frictionally engage the inclined inner surface 35 of the sleeve 90 to retain the sleeve on the section 12 and 14 of the exercise bar are separate and collapsed.

Referring to FIGS. 2, 3, 5, 6A-6C and 8, the exercise bar 10 includes a connecting clip 70. The connecting clip 70 includes a cylindrical, threaded body section 72, circumferentially spaced-apart retaining fingers 74 integrally formed with, and extending outwardly from the body section 72, and circumferentially spaced-apart connecting fingers 76 also integrally formed with and extending outwardly from the body section 72. Moreover, each connecting finger 76 is molded as a single unit with a shorter, retaining finger 74.

Figure 8:
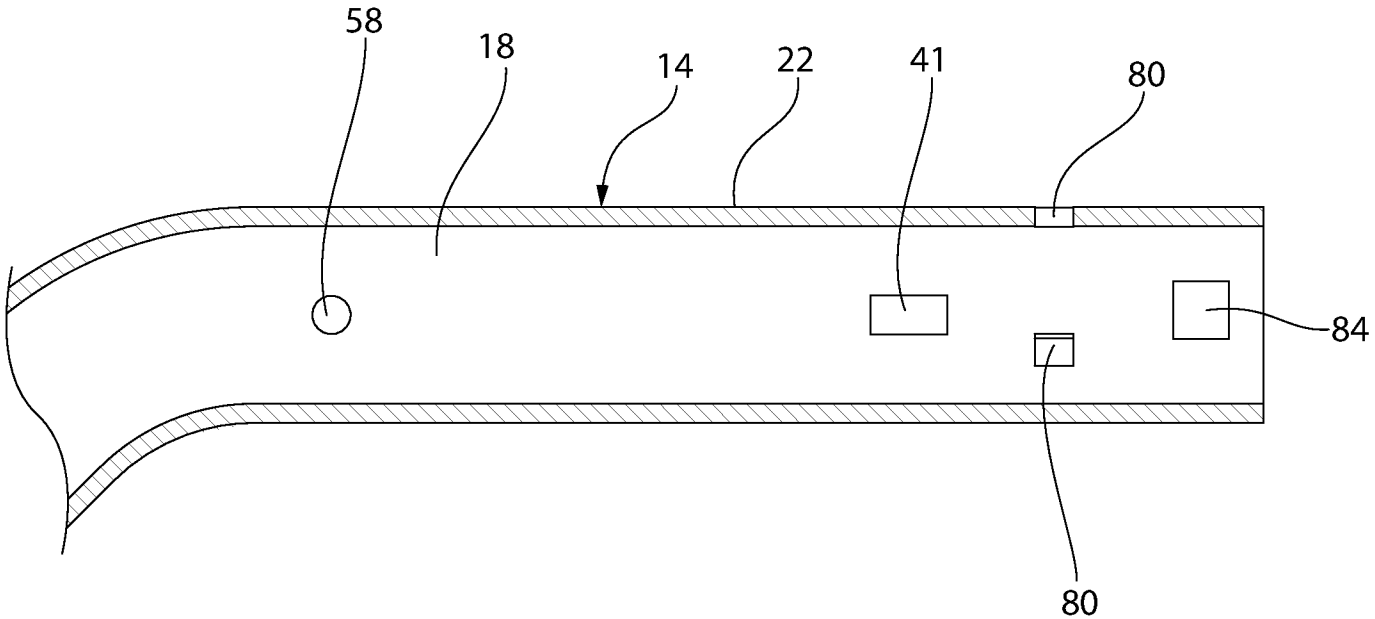
FIG. 8 is a fragmentary section view of one of the collapsible sections of the exercise bar showing an arrangement of passages or openings for receiving components of the collapsible bar.

The retaining fingers 74 are biased inwardly and include inwardly directed projections 78 that engage within aligned openings or passages 80 in peripheral wall 22 of the elongate section 14. (FIG. 8). This serves to retain the connecting clip 70 in proper position on the elongate section 14.

The outwardly extending connecting fingers 76 also are biased inwardly and have inwardly directed projections 82 that extend through aligned openings or passages 84 in the peripheral wall 22 of elongate section 14. (FIG. 8) As described in further detail hereinafter, the projections 82 of the outwardly extending connecting fingers 76 engage within a circumferential groove or recess 86 provided in the outer surface of elongate connector 32 of the elongate section 12, when the sections 12 and 14 are fully connected together in proper position for use of the exercise bar 10.

Referring to FIGS. 1, 2, 7A, 7B and 9A-9D, a retaining member 90 in the form of a sleeve is axially slidable to overlie abutting surfaces of the elongate sections 12 and 14 when those sections are fully connected together in a desired axial and rotational orientation with respect to each other for use of the exercise bar 10. (See FIG. 9D). It should be understood that in this fully connected condition the elongate connector 32 of elongate section 12 telescopes within hollow passage 18 of the elongate section 14.

Figure 7B:
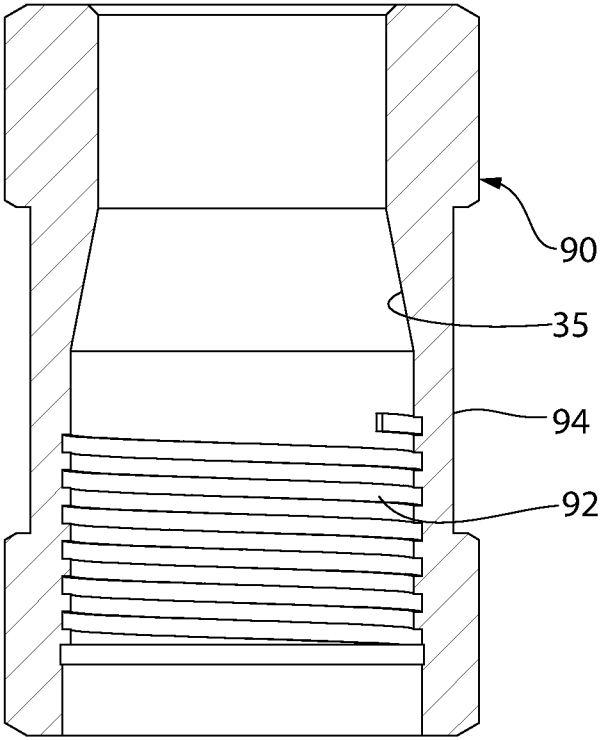
FIG. 7B is a sectional view of the retaining member of FIG. 7A taken along line 7B-7B of FIG. 7A.
Figure 7A:
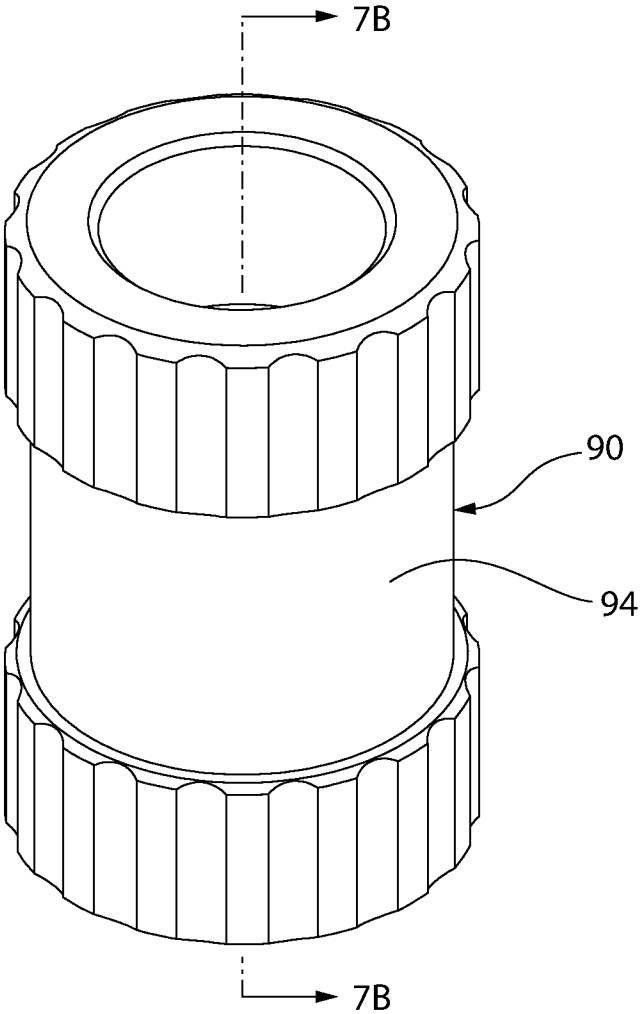
FIG. 7A is an isometric view of a retaining member employed in the collapsible exercise bar of this invention.

Referring specifically to FIGS. 7A and 7B, the sleeve 90 has a threaded interior section 92 for engaging the cylindrical threaded body section 72 of the connecting clip 70 when the sleeve 90 is in a proper position to aid in retaining the elongate sections 12 and 14 in a fully connected position as described in greater detail hereinafter with respect to FIGS. 9A through 9D. Suffice it to state herein that the sleeve 90 overlies the circumferentially spaced-apart connecting fingers 76 and retaining fingers 74 of the connecting clip 70 to prevent outward movement of those fingers. Such outward movement of the fingers 76 could cause the inwardly directed projection 82 thereof to move out of the circumferential groove or recess 64 of the elongate connector 32, which could cause an undesired separation of the elongate sections 12 and 14 from each other during use of the exercise bar 10. In addition, the sleeve 90 prevents undesired outward movement of the retaining fingers 74 (each retaining finger actually be joined to connecting finger 76) to thereby prevent the inward extensions 78 of the retaining fingers from disengaging from within the aligned openings 80 in the peripheral wall 22 of elongate section 14.

Referring to FIGS. 1-3 and 5, the retaining sleeve 90 further includes a central recessed section 94 in the outer periphery thereof. A tether 96, in the form of a fabric strap, is disposed about the central recess section 94 and an attachment ring 98 is secured to the sleeve 90 through the tether. Specifically, one end of the tether is positioned through the attachment ring 98 and folded back on itself to encircle the ring. The opposed end of the tether 96 is placed in abutting relationship with the folder section of the first end; thereby providing three overlying sections that are then stitched together by any suitable stitching 100, as can be clearly seen in FIGS. 1 and 3.

Figure 10:
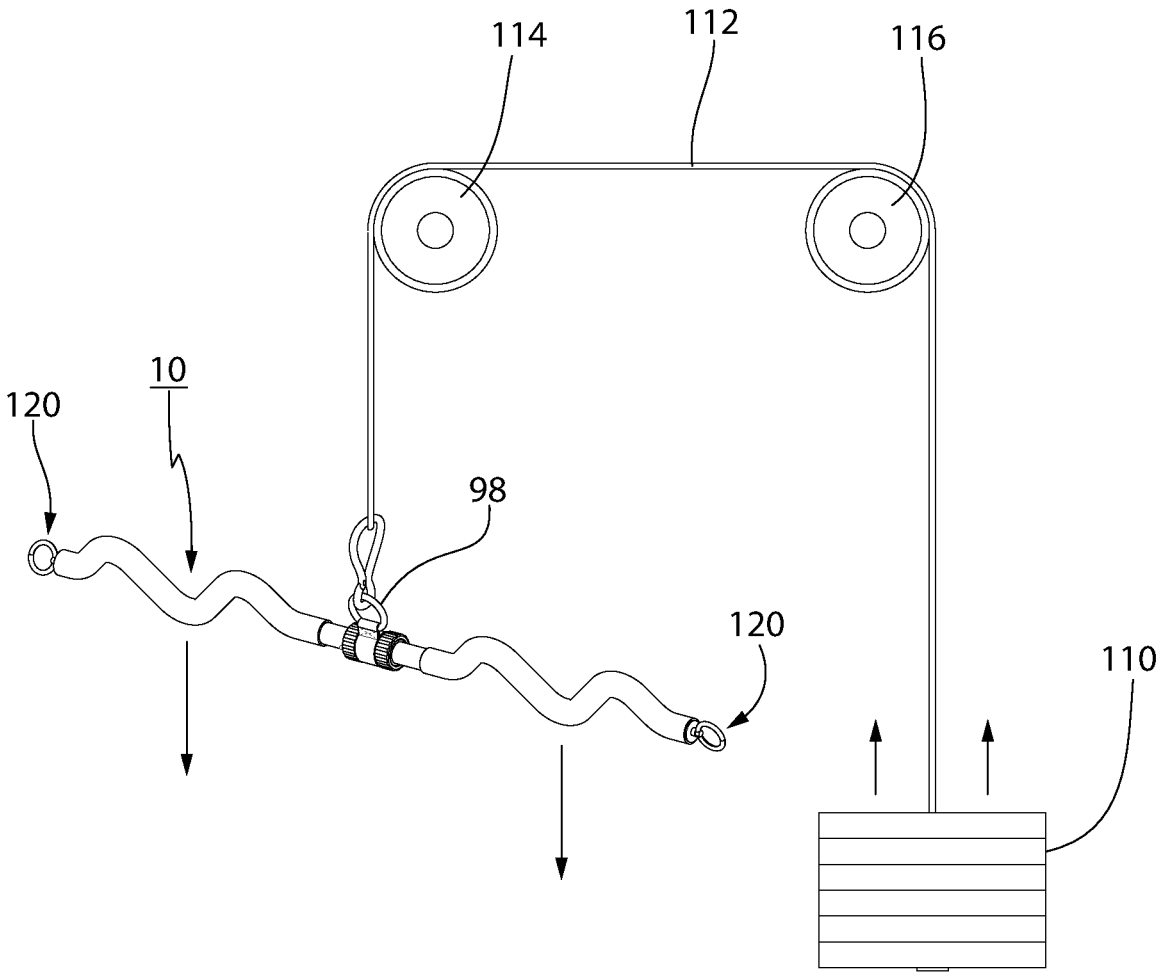
FIG. 10 is a schematic view illustrating use of the collapsible exercise bar with a stack of weights.

As shown schematically in FIG. 10, the attachment ring 98 is configured to be connected to a weight stack 110 through a connecting cable 112 trained over pulleys 114, 116. This is a schematic representation, it being understood that there are numerous types of equipment employing weight stacks, and various ways of connecting weight stacks to an exercise bar to be gripped by a person conducting an exercise for purposes of weight training. Moreover, the attachment ring can be connected to a variety of different resistance devices, such as elastic exercise bands, hydraulic resistance devices and pneumatic resistance devices. The specific resistance device(s) to which the exercise bar of this invention is attached does not constitute a limitation on this invention; this invention being directed to the collapsible exercise bar itself.

Figure 11:
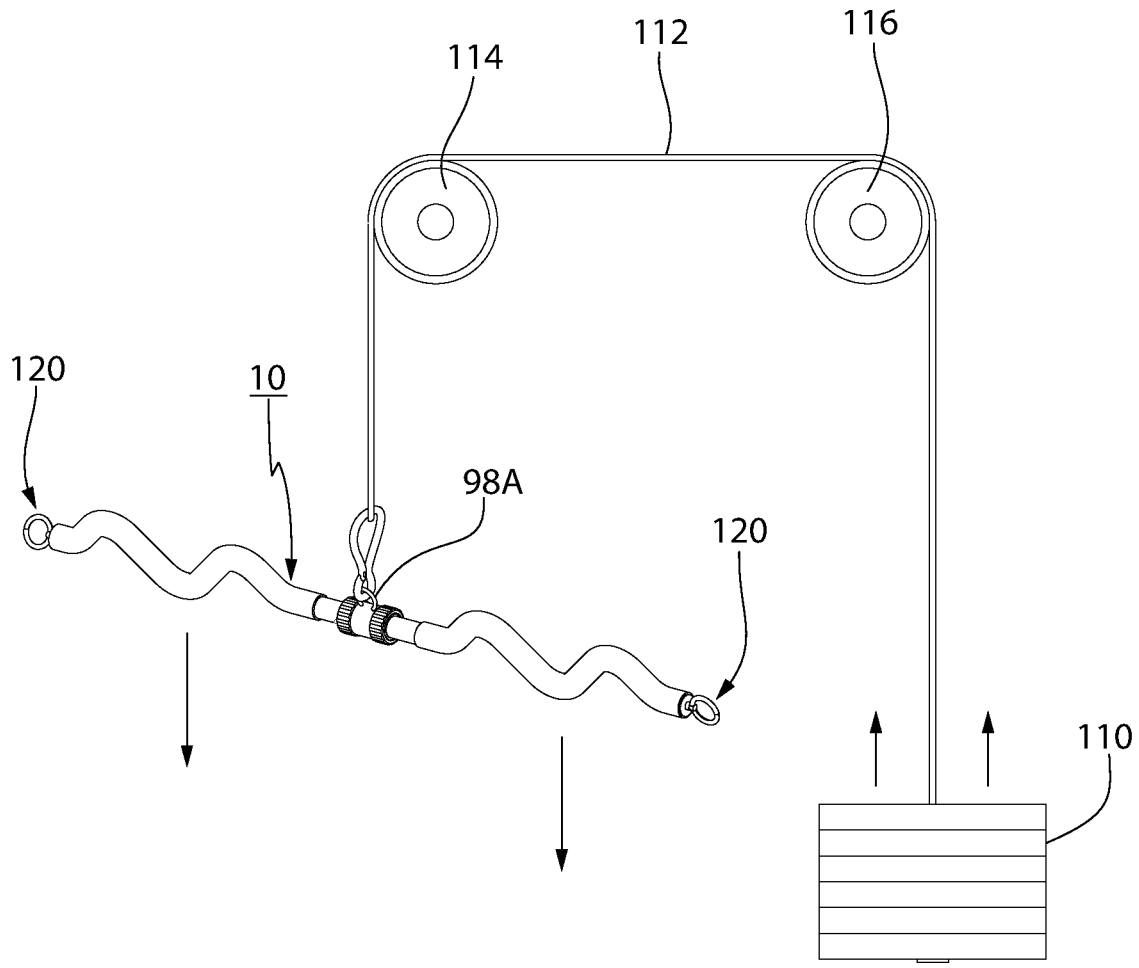
FIG. 11 is a schematic view similar to FIG. 10 but showing a different arrangement for connecting the collapsible exercise bar to a stack of weights.

Referring to FIG. 11, an alternative design of an attachment member for attaching the exercise bar 10 to a stack of weights or other resistance device is illustrated at 118, wherein the attachment member 98A is integrally formed as part of the sleeve 90 without the use of a tether or other separate connecting member or fabric. The particular arrangement of providing an attachment member in conjunction with the sleeve 90 does not constitute a limitation on the broadest aspects of this invention. Reference throughout this application, including the claims, to an attachment member or ring configured for attachment to a weight stack or other resistance device being on, or part of the retaining sleeve 90, includes an attachment member being attached, as a separate member, to the retaining sleeve 90, as well as the attachment member being integrally formed as part of said retaining sleeve.

Referring to FIGS. 1 and 5, a further attachment assembly 120 is schematically represented at opposed free ends of the sections 12 and 14. The attachment assemblies at the opposed ends are of an identical construction, each including a connecting ring 122 having a projection or shaft 124 that is rotatably mounted through a top end cap 126; preferably made of plastic. The projection or shaft 124 includes an annular groove 125 about its periphery and that is axially spaced from the end cap and connecting ring. The shaft extends through bearings 128, 130 and is rotatably mounted therein. The bearings 128, 130 are contiguous to each other and the bearing 128 seats against the inner surface of the top end cap 126. The bearings 128, 130 are retained in position within each of the assemblies 120 by a generally U-shaped spring clip 132 that snaps into engagement with the annular groove 125 of the projection or shaft 124. Therefore, the bearings 128, 130 are retained between the top end 126 and the spring clip 132, respectively. Glue is applied to the insider surface of the sections 12 and 14 and the assemblies 120 are then inserted into the sections to adhesively attach the bearings 128, 130 to the inner surface of those sections. To assure a firm, bonded connection between the bearings 128, 130, on the one hand, and the sections 12 and 14, a punch machine or press is employed to punch the sections 12 and 14 inwardly from the outer surfaces thereof to tighten the assemblies 120 and exercise bar sections 12 and 14 together.

The connecting ring 122 of the axially spaced apart attachment assemblies 120 can be connected to spaced-apart weight stacks or other resistance devices, including spaced-apart exercise bands, hydraulic exercise devices, pneumatic exercise devices, etc., thereby permitting use of the exercise bar to provide a variety of different pulling and pushing exercises, including, but not limited to, bicep curls, triceps pushes, upright rows, lat pulldown, etc.

As noted above, the exercise bar 10 is formed of collapsible sections 12 and 14 to permit easy transport and/or storage of the bar 10.

Referring to FIGS. 9A through 9D, sequential steps of positioning and connecting the sections 12 and 14 into proper alignment for use of the exercise bar 10 are illustrated.

FIG. 9A shows elongate sections 12 and 14 positioned in axially alignment with each other, prior to connecting them together, by moving them into telescoping relationship in the direction of the depicted arrows.

FIG. 9B shows elongate sections 12 and 14 in an intermediate position during the connecting operation. In this position the chain randomly folds or collapses into the interior 18 of elongate section 14. In addition, to permit continued axial, inward movement of the sections 12 and 14 relative to each other, those sections are positioned in a proper rotational orientation in which the downward projection 40 on sleeve 14 is aligned with the axial extending recess 38 in the elongate connector 32. It is only when the recess 38 is aligned to receive projection 40 therein that the two elongate sections 12 and 14 can be completely attached to each other for use of the bar 10, with the elongate connector 32 of section 12 telescoped within the hollow interior of the elongate section 14. As noted earlier, in the most preferred embodiment of this invention the entrance end of recess 38 is wedge shaped to guide the projection 40 into the recess. Although preferred this wedge-shaped configuration is not required in accordance with the broadest aspects of this invention.

It should be noted that rotational alignment of the sections 12 and 14 is a very important feature of this invention when those sections include undulating segments that need to be maintained in a common plane during use of the exercise bar 10. Such a controlled rotational orientation also is important when the two elongate sections 12 and 14 include other types of segments, such as handles, located in a different axial orientation then other segments of the corresponding elongate sections 12 and 14 of the exercise bar 10.

Referring to FIG. 9C, the two elongate sections 12 and 14 are moved into a completely connected condition with inwardly directed projections 82 of the connecting fingers 76 of the connecting clip 70 extending through openings 84 in the outer wall of elongate section 14 and into the circumferential groove 86 of the elongate connectors 32. Although connected together it is important that this connection be maintained. That is, accidental separation of projections 84 from the circumferential groove 86 and inadvertent separation of the connecting clip 70 from the section 14 needs to be prevented.

Referring to FIG. 9D, retaining sleeve 90 is provided to prevent inadvertent separation of the connecting clip 70 from elongate section 14, and also inadvertent separation of the inwardly directed projections 82 of connecting fingers 76 from circumferential groove 86 of the elongate connector 32 of connecting section 12. When the sections 12 and 14 are connected together the retaining sleeve 90 is moved axially to overly the connecting clip 70, and threaded interior section 92 of the sleeve is threadedly connected to the threaded outer section 72 of the connecting clip 70 to thereby prevent undesired axial movement of the retaining sleeve 90 relative to the elongate sections 12 and 14 and the connecting clip 70 of the exercise bar 10.

Referring to FIGS. 7B and 9D, the inner surface of the sleeve 90 includes an axially inclined, circumferential interior surface 35 that engages with a contiguous outer surface segment of each of the connecting fingers 76 to prevent those fingers from moving outwardly; thereby preventing inadvertent separation of the inwardly directed projections 82 of the connecting fingers from the circumferential groove 86 of the elongate connector 32. Thus, the sleeve 90 provides the important function of retaining the connection between the connecting clip 70 and the elongate sections 12 and 14 of the exercise bar 10.

Figure 6A:
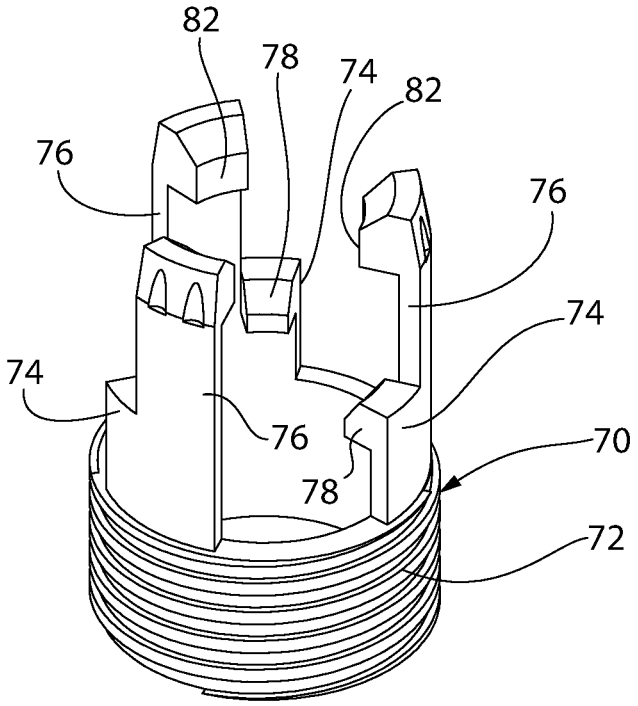
FIG. 6A is an isometric view of a connecting clip employed in the collapsible exercise bar of this invention.
Figure 6B:
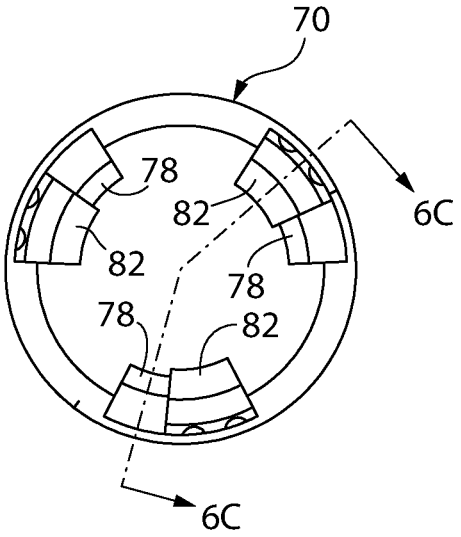
FIG. 6B is a plan view of the connecting clip shown in FIG. 6A.
Figure 6C:
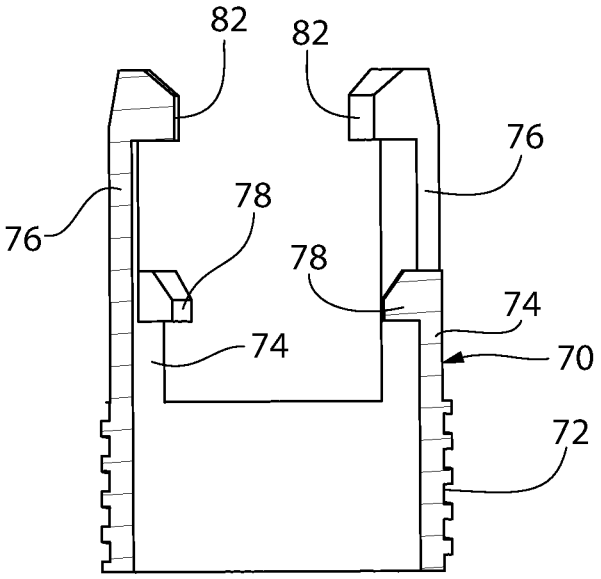
FIG. 6C is a sectional view of the connecting clip employed in this invention, taken along line 6C-6C of FIG. 6B.

Moreover, as can be seen most clearly in FIG. 6A, each of the retaining fingers 74 is integrally molded with a connecting finger 76. Therefore, engagement of the axially inclined interior surface 35 of the sleeve 90 with the contiguous outer surface segment also retains the inwardly direct projections 78 of the retaining fingers within the openings 80 in the peripheral wall 22 of the elongate section 14.

Although the present invention has been described in connection with preferred embodiments thereof, it will be appreciated by those skilled in the art that additions, modifications, substitutions and deletions not specifically described may be made without departing from the spirit and scope of the invention defined in the appended claims.

What is claimed is:

1. A collapsible exercise bar including:

two elongate sections;

a joining connector joining the two elongate sections together to permit said two elongate sections to move relative to each other between a position in which the two elongate sections are aligned for use of the bar, and a folded position in which the two elongate sections are generally parallel to each other;

a retainer member slidable relative to the two elongate sections and including an attachment section for engaging a cooperating attachment section on one of said two elongate sections to immobilize said retainer member with said retainer member overlying contiguous edges of said two elongate sections when said two elongate sections are aligned for use of the bar; and at least one additional connector on the exercise bar configured to be connected to a resistance device.

2. The collapsible exercise bar of claim 1, said at least one additional connector including a connector on said retainer member.

3. The collapsible exercise bar of claim 1, wherein said at least one additional connector includes a connector on an outer end of each of said elongate sections spaced from the joining connector, said connectors on the outer end of each of said elongate sections being configured to be connected to a resistance device when said elongate sections are aligned for use of the exercise bar.

4. The collapsible exercise device of claim 1, said at least one additional connector including a first connector on said retainer member and second and third connectors on outer ends, respectively, of each of said elongate sections spaced from the joining connector, said second and third connectors on the outer ends of said elongate sections, respectively, and said first connector being configured to be connected to a resistance device when said elongate sections are aligned for use of the exercise bar.

5. The collapsible exercise bar of claim 1, each of said two elongate sections including undulating segments to be gripped by an individual when said two elongate sections are aligned for use of the bar, said two elongate sections including cooperating members configured to engage with each other only when said two elongate sections are in a desired rotational orientation and to maintain said two elongate sections in said desired rotational orientation.

6. The collapsible exercise bar of claim 1, each of said two elongate sections including undulating segments to be gripped by an individual when said two elongate sections are aligned for use, said two elongate sections including cooperating members configured to engage with each other only when said two elongate sections are in a desire rotational orientation and to maintain said two elongate sections in said desired rotational orientation; said cooperating members including an inwardly directed projection on one of said elongate section and being biased inwardly and an axially extending groove associated with the other of said two elongate sections, said inwardly directed projection cooperating with surfaces defining said axially extending groove only when said two elongate sections are linearly and rotationally aligned for use of the exercise bar.

7. The collapsible exercise bar of claim 1, each of said two elongate sections including undulating segments to be gripped by an individual when said two elongate sections are connected to each other in alignment for use of the bar with the undulating segments of both elongate sections being in the same plane, means for permitting connection of the two elongate sections in alignment for use of the bar only when the undulating segments of the two elongate sections are in the same plane.

8. The collapsible exercise bar of claim 1, wherein said at least one additional connector includes a connector connected to said retainer member.

9. The collapsible exercise bar of claim 1, wherein said at least one additional connector includes a connector connected to said retainer member through a tether disposed about the retainer member.

10. The collapsible exercise bar of claim 1, said at least one additional connector including a connector integrally formed as part of said retainer member.

11. The collapsible exercise bar of claim 1, further including a locking device secured to one of said two elongate sections, said locking device having a locking member for engaging a locking region associated with said other of said two elongate sections for maintaining the two elongate sections aligned for use of the bar.

12. The collapsible exercise bar of claim 11, said two elongate sections including cooperating end segments, one of said cooperating end segments being an outer telescoping segment and the other of said cooperating end segments being an inner telescoping segment, said inner telescoping segment being seatable within said outer telescoping segment when said two elongate sections are aligned for use of said exercise bar, said locking device being secured to said outer telescoping segment, said locking member of said locking device including an inwardly directed projection normally flexibly biased inwardly, said inner telescoping segment including said locking region, said locking region being an elongate recess in an outer wall of said inner telescoping segment, said inwardly directed projection engaging within said elongate recess when said inner telescoping segment is fully seated within said outer telescoping segment for use of the exercise bar.

13. The collapsible exercise bar of claim 11, said two elongate sections including cooperating end segments, one of said cooperating end segments being an outer telescoping segment and the other of said cooperating end segments being an inner telescoping segment, said inner telescoping segment being seatable within said outer telescoping segment when said two elongate sections are aligned for use of said exercise bar, said locking device being secured to said outer telescoping segment, said locking member of said locking device including an inwardly directed projection normally flexibly biased inwardly, said inner telescoping segment including said locking region, said locking region being an elongate recess in an outer wall of said inner telescoping segment, said inwardly directed projection engaging within said elongate recess when said inner telescoping segment is fully seated within said outer telescoping segment for use of the exercise bar, said retainer member including an inner surface for engaging said locking device and providing an inward force for aiding in maintaining said projection in said recess.

14. The collapsible exercise bar of claim 1, each of said two elongate sections including undulating segments to be gripped by an individual when said two elongate sections are aligned for use of said exercise bar, said two elongate sections including cooperating end segments, one of said cooperating end segments being an outer telescoping segment and the other of said cooperating end segments being in inner telescoping segment, said inner telescoping segment being seatable within said outer telescoping segment when said two elongate sections are aligned for use of the exercise bar, said cooperating end segments including a locking device including a locking member cooperating with a locking region for engagement with each other and permitting the cooperating end segments to telescope together into a seated condition for use of the exercise bar only when the undulating segments of the two elongate section are substantially in the same plane, and for preventing rotation of the two elongate sections relative to each other to maintain said undulating segments of the two elongate sections substantially in the same plane during use of the exercise bar, said locking device being secured to said outer telescoping segment, said locking member of said locking device including an inwardly directed projection normally flexibly biased inwardly, said inner telescoping segment including said locking region, said locking region being an elongate recess in an outer wall of said inner telescoping segment, said projection engaging within said recess region when said inner telescoping segment is fully seated within said outer telescoping segment.

15. The collapsible exercise bar of claim 1, each of said two elongate sections including undulating segments to be gripped by an individual when said two elongate sections are aligned for use of said exercise bar, said two elongate sections including cooperating end segments, one of said cooperating end segments being an outer telescoping segment and the other of said cooperating end segments being in inner telescoping segment, said inner telescoping segment being seatable within said outer telescoping segment when said two elongate sections are aligned for use of the exercise bar, said cooperating end segments including a locking device including a locking member cooperating with a locking region for engagement with each other and permitting the cooperating end segments to telescope together into a seated condition for use of the exercise bar only when the undulating segments of the two elongate section are substantially in the same plane, and for preventing rotation of the two elongate sections relative to each other to maintain said undulating segments of the two elongate sections substantially in the same plane during use of the exercise bar, said locking device being secured to said outer telescoping segment, said locking member of said locking device including an inwardly directed projection normally flexibly biased inwardly, said inner telescoping segment including said locking region, said locking region being an elongate recess in an outer wall of said inner telescoping segment, said projection engaging within said recess region when said inner telescoping segment is fully seated within said outer telescoping segment, said retainer member including an inner surface for engaging said locking device and providing an inward force for aiding in maintaining said projection in said elongate recess.

16. The collapsible exercise bar of claim 1, wherein said joining connector joining the two elongate sections together to permit said two elongate sections to move relative to each other between a position in which the two elongate sections are aligned for use of the bar and a folded position in which the two elongate sections are generally parallel to each other is a flexible member.

17. The collapsible exercise bar of claim 1, wherein said joining connector joining the two elongate sections together to permit said two elongate sections to move relative to each other between a position in which the two elongate sections are aligned for use of the bar, and a folded position in which the two elongate sections are generally parallel to each other is a flexible chain.

* * * * *